US005988717A

United States Patent [19]

Foust

[11] Patent Number: 5,988,717

[45] Date of Patent: Nov. 23, 1999

[54] METHOD FOR MOVING A VACUUM LIFTER ON AND OFF AN OBJECT

[75] Inventor: John W. Foust, Nampa, Id.

[73] Assignee: Micron Electronics, Inc., Nampa, Id.

[21] Appl. No.: 08/994,522

[22] Filed: Dec. 19, 1997

[51] Int. Cl.[6] ..... B66C 1/02

[52] U.S. Cl. ..... 294/64.1; 414/627

[58] Field of Search ..... 294/64.1, 65, 65.5; 414/737, 627, 752; 901/40; 271/11, 94, 95

[56] References Cited

U.S. PATENT DOCUMENTS

| | | | |
|---|---|---|---|
| 3,858,926 | 1/1975 | Ottenhues | 294/65 |
| 4,021,030 | 5/1977 | Fichte et al. | 271/11 |
| 4,822,236 | 4/1989 | Inoue et al. | 414/627 |
| 4,846,625 | 7/1989 | Gabillet | 414/752 |
| 5,645,274 | 7/1997 | Ubayashi et al. | 271/94 |

FOREIGN PATENT DOCUMENTS

| | | | |
|---|---|---|---|
| 4229208 | 3/1994 | Germany | 294/64.1 |
| 0004840 | 1/1982 | Japan | 294/64.1 |
| 1049405 | 10/1983 | U.S.S.R. | 294/64.1 |
| 1058865 | 12/1983 | U.S.S.R. | 294/64.1 |

OTHER PUBLICATIONS

Product Bulletin *VT Series Vacuum Lift System* (Anver Corporation) Date Unknown, 3 pages.

*Primary Examiner*—Dean J. Kramer
*Assistant Examiner*—Paul Chin
*Attorney, Agent, or Firm*—Trop, Pruner, Hu & Miles, P.C.

[57] ABSTRACT

The present invention, in one embodiment, is a method for moving a vacuum lifter off an object. The method includes releasing a vacuum holding a surface of the object against a sealing plate of the vacuum lifter and rolling the vacuum lifter along the surface on a roller. The roller is connected to the vacuum lifter.

19 Claims, 8 Drawing Sheets

METHOD FOR MOVING A VACUUM LIFTER ON AND OFF AN OBJECT

BACKGROUND OF THE INVENTION

1. Field of the Invention

This invention relates generally to a method and apparatus for lifting objects, and more particularly, for a method for rolling a vacuum lifter off an object.

2. Description of the Related Art

FIG. 1 illustrates a prior art vacuum lifter 10 for lifting and transporting an object 12. The object 12 may take any form as long as at least one surface 14 is smooth and firmly fixed to the object 12. The vacuum lifter 10 includes an overhead vacuum hose 16 that is airtight. The overhead hose 16 has a substantially vertical portion terminating in a first end hermetically connected to the intake of a vacuum pump (not shown). A second end of the overhead hose 16 hermetically connects to a metal housing 18. The hose 16 is supported by an overhead structure (not shown) that supports the weight of both the lifter 10 and, when lifted, the object 12. In some cases, the overhead structure includes rollers and tracks (not shown) that facilitate horizontal displacements of the loaded lifter 10.

The housing 18 has airtight internal passages (not shown) that connect the overhead hose 16 to one or more secondary hoses 20. The housing 18 also has a support structure 22 fixedly connecting one or more sealing plates 24 to the bottom thereof. Each secondary hose 20 hermetically connects to an upper surface of the sealing plate 24 and connects with a lower surface thereof through one or more holes 26 that pierce the sealing plate. A pliable sealing ring 30 attaches to the entire perimeter of the lower surface of each sealing plate 24. The sealing ring 30 hermetically seals the lower surface of the sealing plate 24 to the top surface 14 of the object 12 upon compression therebetween.

One or more handles 28 project from the housing 18. A control lever 32 projecting from the housing 18 operates internal valves (not shown) regulate the vacuum pressure in the secondary hoses 20. The vacuum lifter 10 forms a sealed conduit between the intake of the vacuum pump (not shown) and the surface 14 of the object 12 when a vacuum is created therein.

FIG. 2A illustrates the operation of the vacuum lifter 10. The vacuum lifter 10 is positioned so that the sealing plate 24 is snug against the smooth surface 14 of the object 12. A vacuum is produced between the surface 14 and the sealing plates 24 by means of the secondary hoses 20. The vacuum forms a suction that grips the object 12 to the lifter 10. Since the conduit formed by the overhead hose 16 between the sealing plates 24 and the vacuum pump (not shown) is hermetically sealed, the vertical portion of the overhead hose 16 is flexible and shortens as the vacuum therein is increased.

As the vertical portion of the overhead hose 16 shortens, the object 12 is lifted off the ground 34. An operator 36 may adjust the height of the object with the control lever 32 that regulates the vacuum in the overhead hose 16 and the length thereof by allowing air to enter through valves (not shown) connected to the outside. After the object 12 is positioned at the desired height, the operator 36 moves the vacuum lifter 10 and the attached object 12 by pushing or pulling with the handles 28 or by pushing or pulling on the object 12 itself.

FIG. 2B illustrates the removal of the vacuum lifter 10 from the object 12 after the object 12 is positioned on the desired surface 38. The operator 36 allows air to enter the secondary hoses 20 to release the vacuum between the sealing plates 24 and the surface 14. The object 12 is consequently released from the vacuum lifter 10. After the vacuum is released, the operator 14 attempts to slide the vacuum lifter 10 off without disturbing the positioning of the object 12.

Since the vacuum lifter 10 is heavy, the operator 36 may have difficulty in sliding the lifter 10 both on and off the object 12 to be lifted. Sliding the vacuum lifter 10 on or off is specially difficult when the object 12 has been placed on a surface above the shoulders of the operator 36. Since the vacuum lifter 10 cannot be easily slid on or off objects 12 positioned at shoulder height, the lifter 10 is less useful as a warehouse tool.

Some vacuum lifters 10 allow reversing the air flow in the secondary hoses 20. After the air flow is reversed, the lifter 10 rests on a cushion of air between the sealing plates 24 and the surface 14 of the object 12. The cushion of air facilitates sliding the vacuum lifter 10 on or off the object 12. Unfortunately, reversing the air flow in the vacuum lifter 10 requires relatively substantial time because the overhead hose 16 is wide and must generally be refilled with air. For such prior art lifters 10, the operator 36 may have to wait thirty seconds for the vacuum pump to form a sufficient air cushion. In some other lifters 10, a reversal of the airflow is inconvenient because reversing the airflow eliminates the lifting force exerted by the overhead hose 16. These construction and time delay constraints compromise the usefulness of reversal of the internal airflow as an aid to sliding the lifter 10 on or off an object.

The present invention is directed to overcoming, or at least reducing the effects of, one or more of the problems set forth above.

SUMMARY OF THE INVENTION

The present invention, in one embodiment, is a method for moving a vacuum lifter off an object. The method includes releasing a vacuum holding a surface of the object against a sealing plate of the vacuum lifter and rolling the vacuum lifter along the surface on a roller. The roller is connected to the vacuum lifter.

Figure 1:
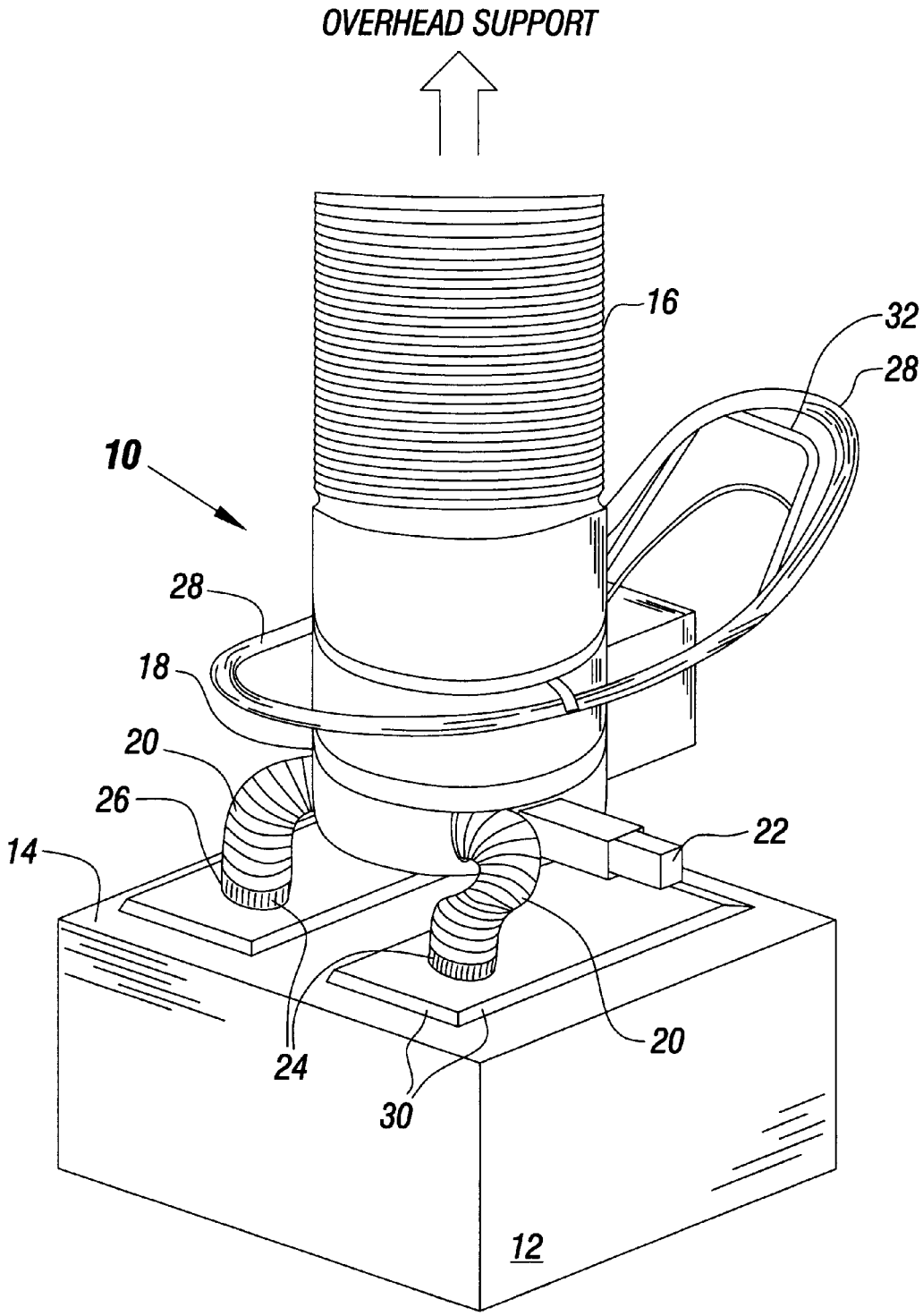
FIG. 1 (PRIOR ART)
FIG. 1 illustrates a prior art vacuum lifter for raising and moving heavy or bulky objects.
Figure 2A:
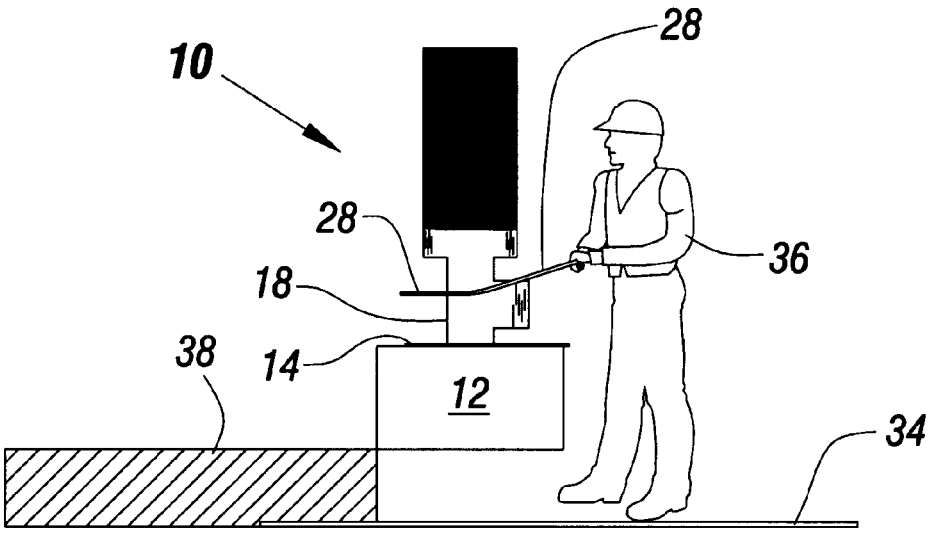
FIG. 2A (PRIOR ART)
FIGS. 2A–2B illustrate the operation of the prior art lifter of FIG. 1.
Figure 2B:
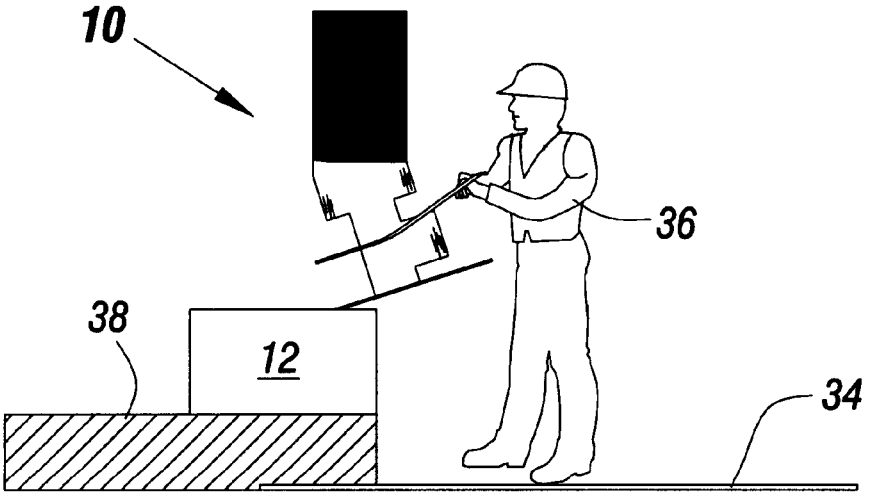
FIG. 2B (PRIOR ART)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would nevertheless be a routine undertaking for those of ordinary skill in the art having the benefit of this disclosure.

A First Embodiment of a New Vacuum Lifter

Figure 3:
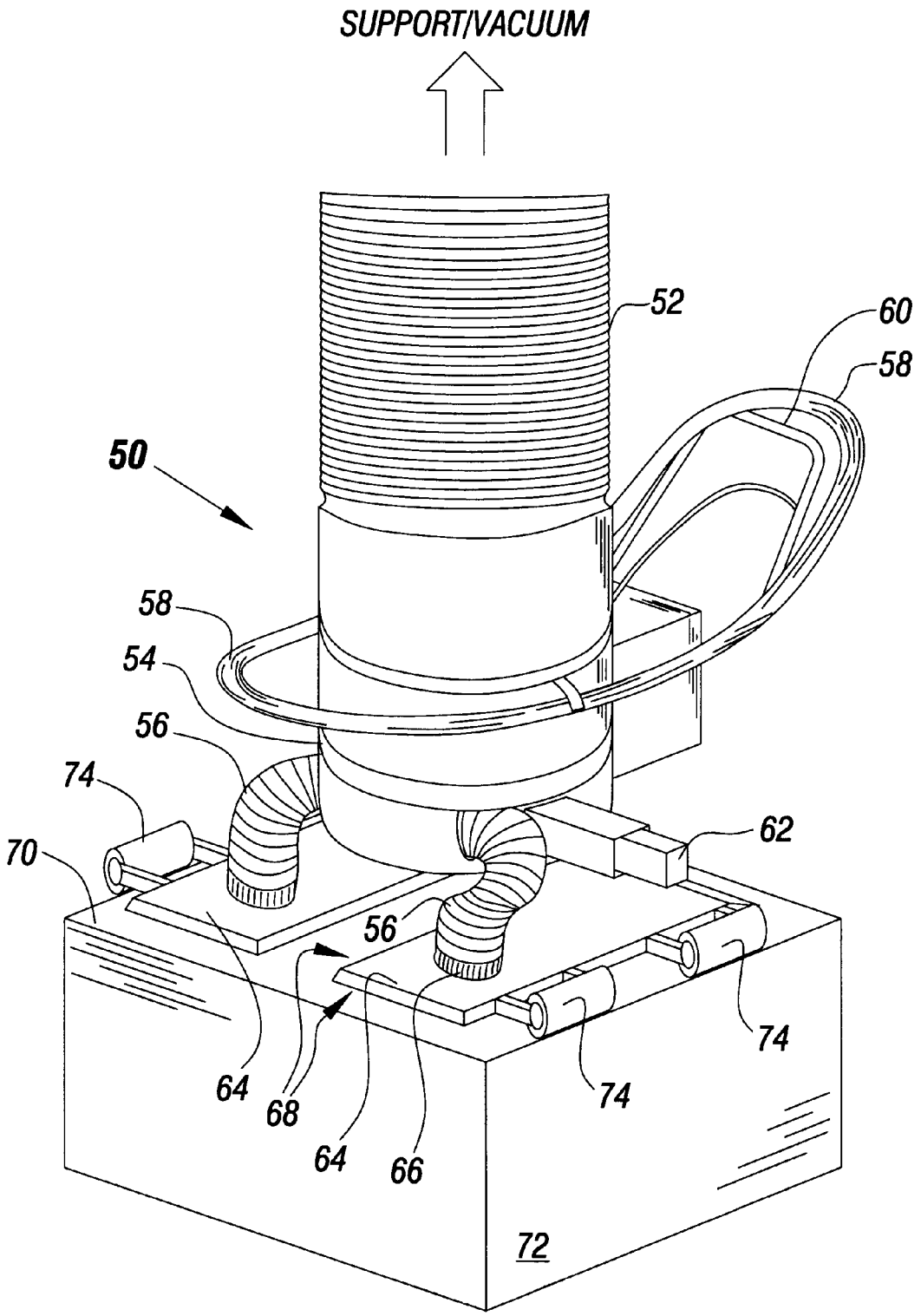
FIG. 3 illustrates a first embodiment for an improved vacuum lifter constructed in accordance with the present invention.

FIG. 3 illustrates a first embodiment 50 for an improved vacuum lifter constructed in accordance with the present invention. The vacuum lifter 50 has an overhead hose 52 with a substantially vertical portion, a housing 54, secondary hoses 56, handles 58, control levers 60, and a structure 62 for rigidly or rotatably affixing one or more sealing plates 64 to the housing 54. Each sealing plate 64 has a pliable sealing ring 66 encircling the edges 68 of the lower surface thereof. The sealing rings 66 hermetically seal the sealing plates 64 to a portion of a surface 70 of the object 72 when compressed.

The overhead hose 52, housing 54, secondary hoses 56, sealing plates 64, and sealing rings 66 form a hermetic conduit between the intake of a vacuum pump (not shown) and portions of the surface 70 of the object 72 to be lifted. When a vacuum is formed in the conduit, a suction grips the object 72 to the sealing plates 64 of the lifter 50. For the surface 70 having flat and cylindrical shapes the sealing plates 64 may have flat and partially cylindrical cross sections, respectively, to improve the seal with the surface 70.

In FIG. 3, the vacuum lifter 50 includes one or more rollers 74. The rollers 74 are rotatably connected to the sealing plates 64 as discussed more fully below relative to FIGS. 4 and 5A–5C. The vacuum lifter 50 may be supported with only the rollers in contact with the surface 70 as discussed more fully below relative to FIGS. 4, 9A–9B, and 5C. If no suction is applied between the surface 70 and the sealing plates 64, the rollers 74 enable displacing the vacuum lifter 50 on the surface 70.

Figure 4:
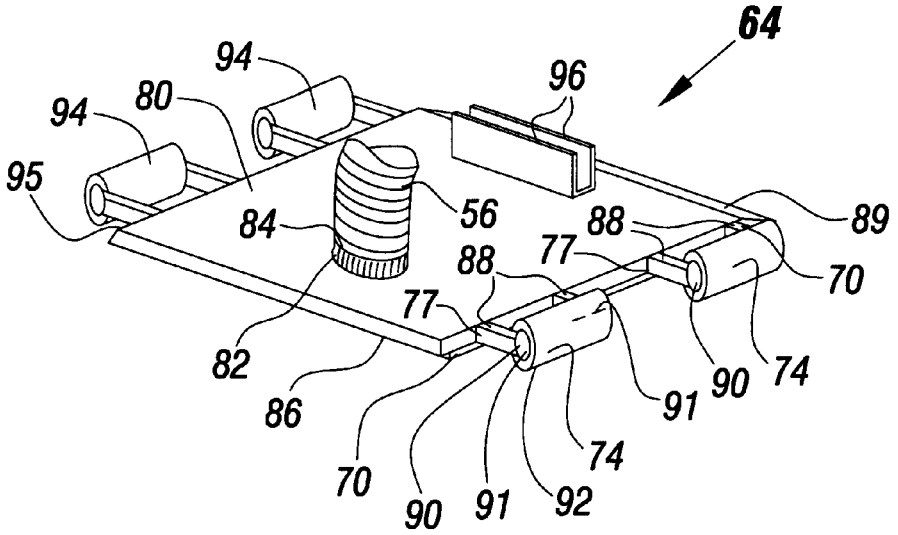
FIG. 4 illustrates an embodiment for an improved sealing plate for use in the vacuum lifter of FIG. 3.

FIG. 4 shows a top surface 80 in one embodiment of the sealing plate 64 in the vacuum lifter 50 of FIG. 3. The secondary hose 56 connects to a fitting 82 that hermetically seals the joint between the secondary hose 56 and the sealing plate 64. A hole 84 pierces the sealing plate 64 connecting the top surface 80 and the lower surface 86 thereof. The sealing ring 66 runs along all of the perimeter of the lower surface 86 of the sealing plate 64. First ends 77 of a plurality of pairs of arms 88 rigidly connect to a first edge 89 of the sealing plate 64. Second ends 90 of each pair of arms 88 connect to opposite ends 91 of an axis 92 running along the center of each roller 74. In some embodiments, a second set of rollers 94 connects to an opposite edge 95 of the sealing plate 64. In other embodiments, a second set of rollers may connect to an adjacent edge or even to all edges of the sealing plate (not shown). One or more structures 96 project from the top surface 80 of the sealing plate 64 to enable rigid connections with the housing 54 of the vacuum lifter 50 as shown in FIG. 3.

Figure 5A:
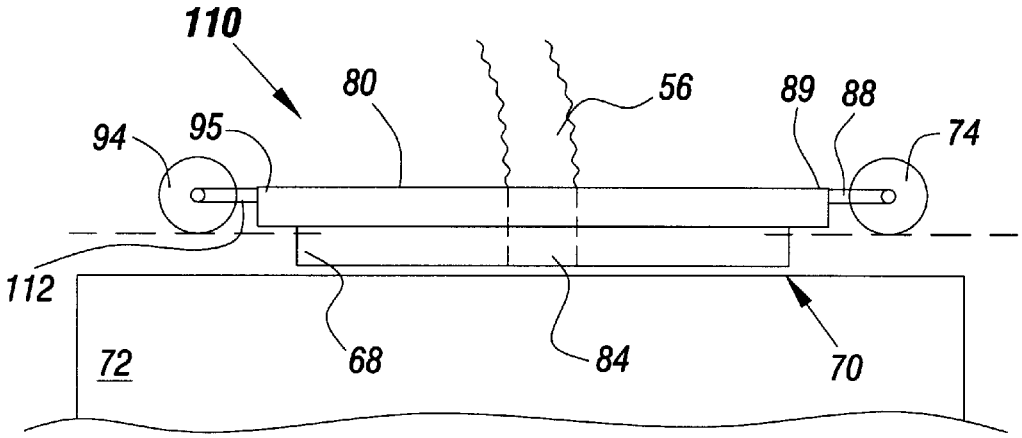
FIGS. 5A–5C are side views of several alternative embodiments for an improved sealing plate as may be employed in the vacuum lifter of FIG. 3.

FIG. 5A is a side view of a first embodiment for the sealing plate 64 of FIG. 3 as previously illustrated in FIG. 4. The two sets of rollers 74 and 94 are attached to opposite edges 89 and 95 of the sealing plate 110 by rigid arms 88 and 112. The diameter of the rollers 74 and 94 is small enough to not interfere with the sealing ring 66 forming a hermetic seal with the surface 70 of the object 72 to be lifted, i.e. the rollers 74 and 94 do not touch the surface 70 when the sealing ring 66 is compressed.

Figure 5B:
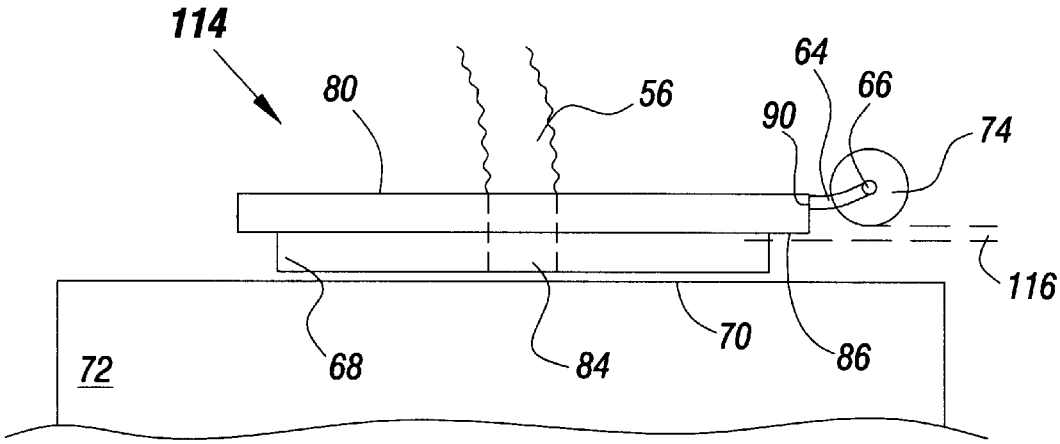

FIG. 5B illustrates a second embodiment 114 for the sealing plate 64 in FIG. 3 in which the arms 88 rigidly attach to the edge 89 of the sealing plate 64. The rigid arms 90 are slightly upturned to enhance the clearance 116 between the roller 74 and the lower surface 86 of the sealing plate 64. The clearance 116 further ensures the roller 74 does not impede the formation of the hermetic seal between the sealing plate 114 and the surface 70 of the object 72 to be lifted.

Figure 5C:
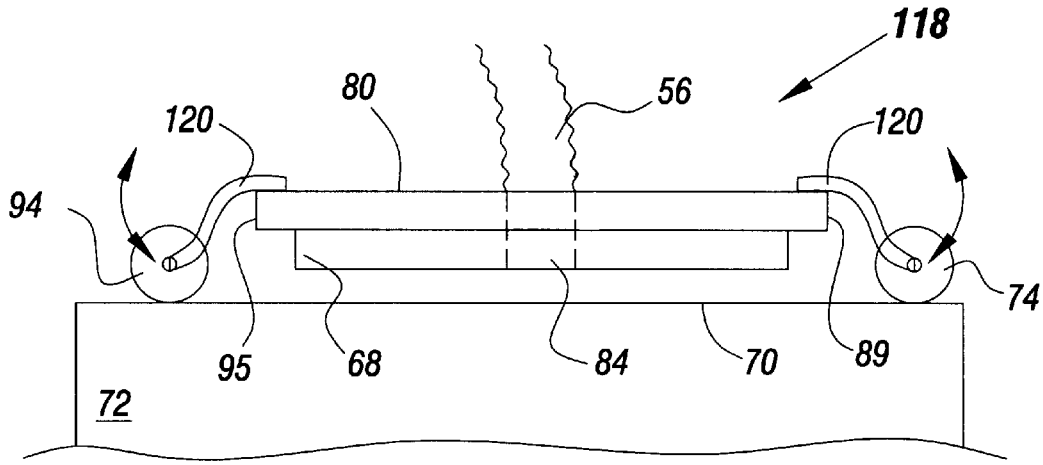

FIG. 5C illustrates a third embodiment for the sealing plate 64 in FIG. 3 in which flexible arms 120 connect the rollers 74 and 94 to the sealing plate 118. When no vacuum is applied the sealing plate 118 rests above the surface 70 supported only by the rollers 74 and 94. When a vacuum is applied to the interior of the flexible arms 120, the pressure difference between the regions between the top and lower surfaces of the sealing plate 64 pushes sealing plate toward the surface 70. Under this vacuum generated force, the arms 120 bend allowing the sealing plates 64 to descend and allowing the sealing ring 66 to form a tight contact with the surface 70. The flexible arms 120 extend the rollers 74 and 94 to a position below the sealing ring 66 in response to the vacuum being released. Releasing the vacuum causes the sealing plate 118 to pop up and rest with only the rollers 74 and 94 making contact with the surface 70.

A Second Embodiment of the New Vacuum Lifter

Figure 6:
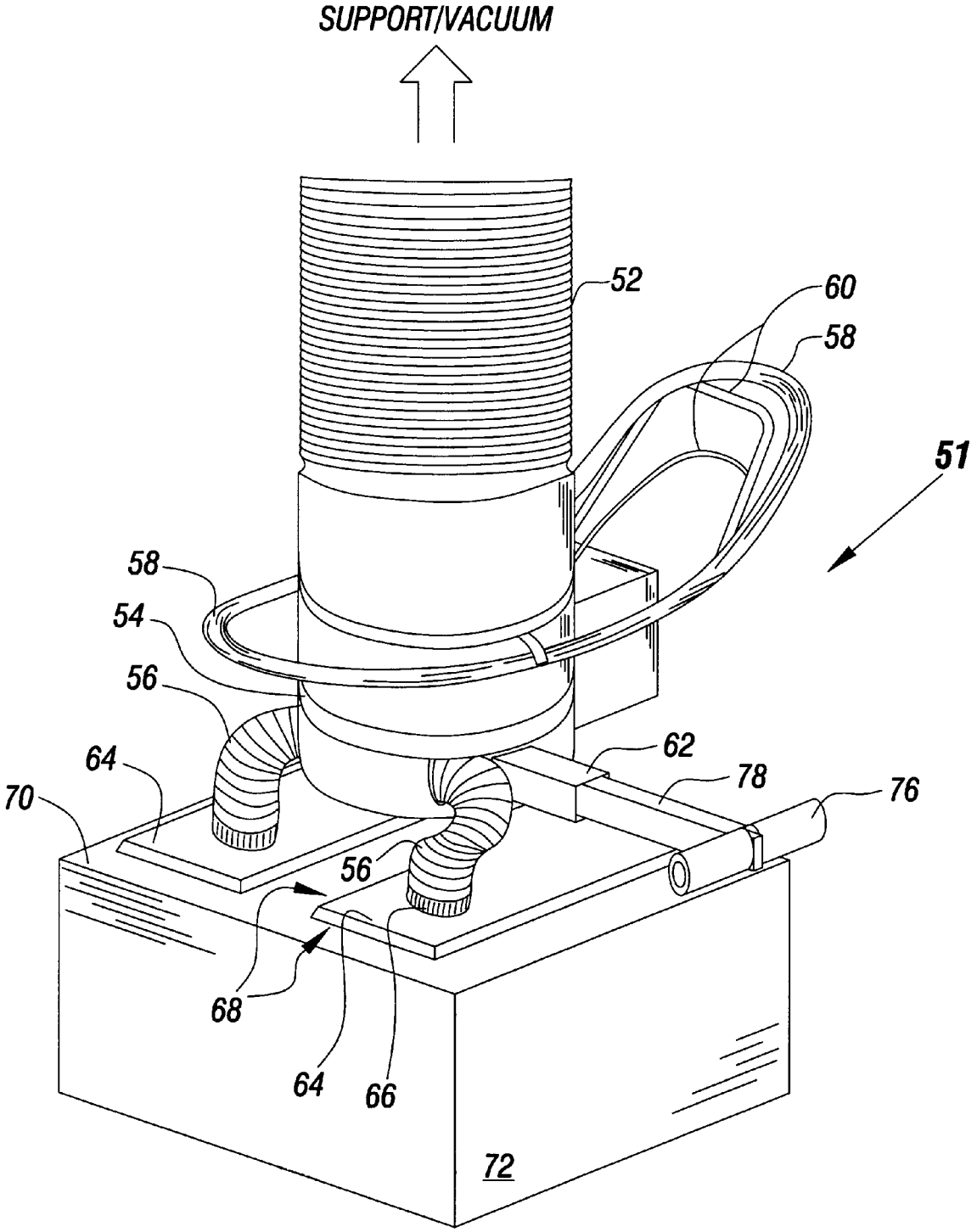
FIG. 6 illustrates a second embodiment for an improved vacuum lifter constructed in accordance with the present invention.

FIG. 6 illustrates a second embodiment 51 for an improved vacuum lifter constructed in accordance with the invention. The vacuum lifter 51 has many parts similar to those of the vacuum lifter 50 in FIG. 3, with like parts bearing like numbers. More particularly, the vacuum lifter 51 has an overhead hose 52 with a substantially vertical portion, a housing 54, secondary hoses 56, handles 58, control levers 60, and a structure 62 for rigidly or rotatably affixing one or more sealing plates 64 to the housing 54. Each sealing plate 64 has a pliable sealing ring 66 encircling the edges 68 of the lower surface thereof. The sealing rings 66 hermetically seal the sealing plates 64 to a portion of a surface 70 of the object 72 when compressed.

The overhead hose 52, housing 54, secondary hoses 56, sealing plates 64, and sealing rings 66 form a hermetic conduit between the intake of a vacuum pump (not shown) and portions of the surface 70 of the object 72 to be lifted. When a vacuum is formed in the conduit, a suction grips the object 72 to the sealing plates 64 of the lifter 51. For the surface 70 having flat and cylindrical shapes, the sealing plates 64 may have flat and partially cylindrical cross sections, respectively, to improve the seal with the surface 70.

In FIG. 6, the vacuum lifter 51 has one or more rollers 76 rotatably connected to the sealing plates 64 as discussed more fully below relative to FIG. 7. The rollers 76 are rotatably connected to an arm 78 rigidly connected to the structure 62 or to the housing 54. The vacuum lifter 51 must be tilted by more than a preselected angle with respect to the general axis of the substantially vertical portion of the overhead hose 52 before being supported on the surface 70 by the rollers 76. If no suction is applied between the surface 70 and the sealing plates 64, the rollers 76 enable displacing the vacuum lifter 51 on the surface 70.

Figure 7:
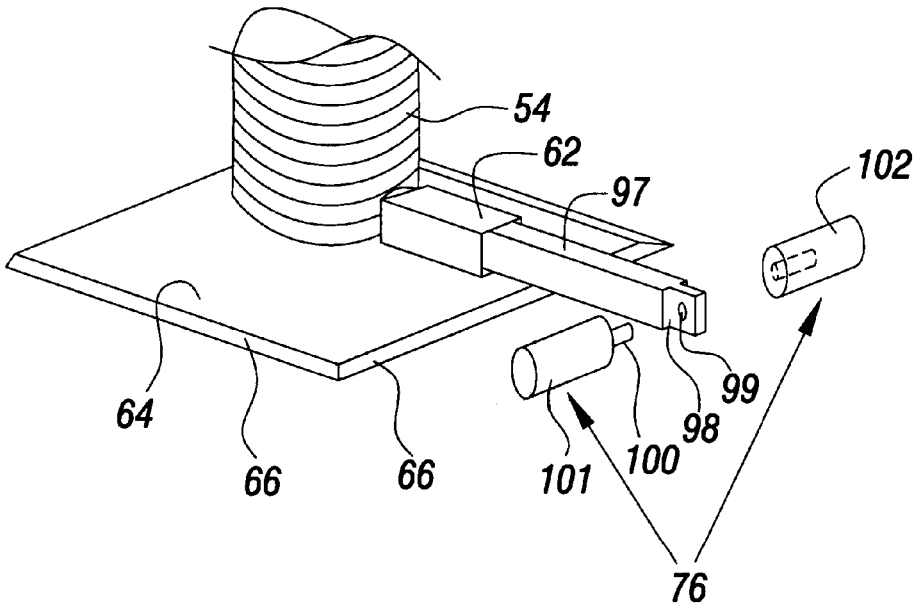
FIG. 7 illustrates an embodiment for the roller of the vacuum lifter of FIG. 6.

FIG. 7 illustrates one embodiment of the roller 76 for the vacuum lifter 51 of FIG. 6. A rigid arm 97 is rigidly connected to the structure 62 affixed to the housing 54. The distal end 98 of the arm 97 is tapered and perforated by a horizontal hole 99. The hole 99 forms a joint with an axle 100 allowing rotational movement by the roller 76. The roller 76 has a male and female parts 101 and 102 that are rigidly connected by a distal portion of the axle 100 inserted into the female part 102 of the roller 76. In other embodiments, a second roller (not shown) may connect to the opposite side of the structure 62.

A Method for Operating the Vacuum Lifter

Figure 8:
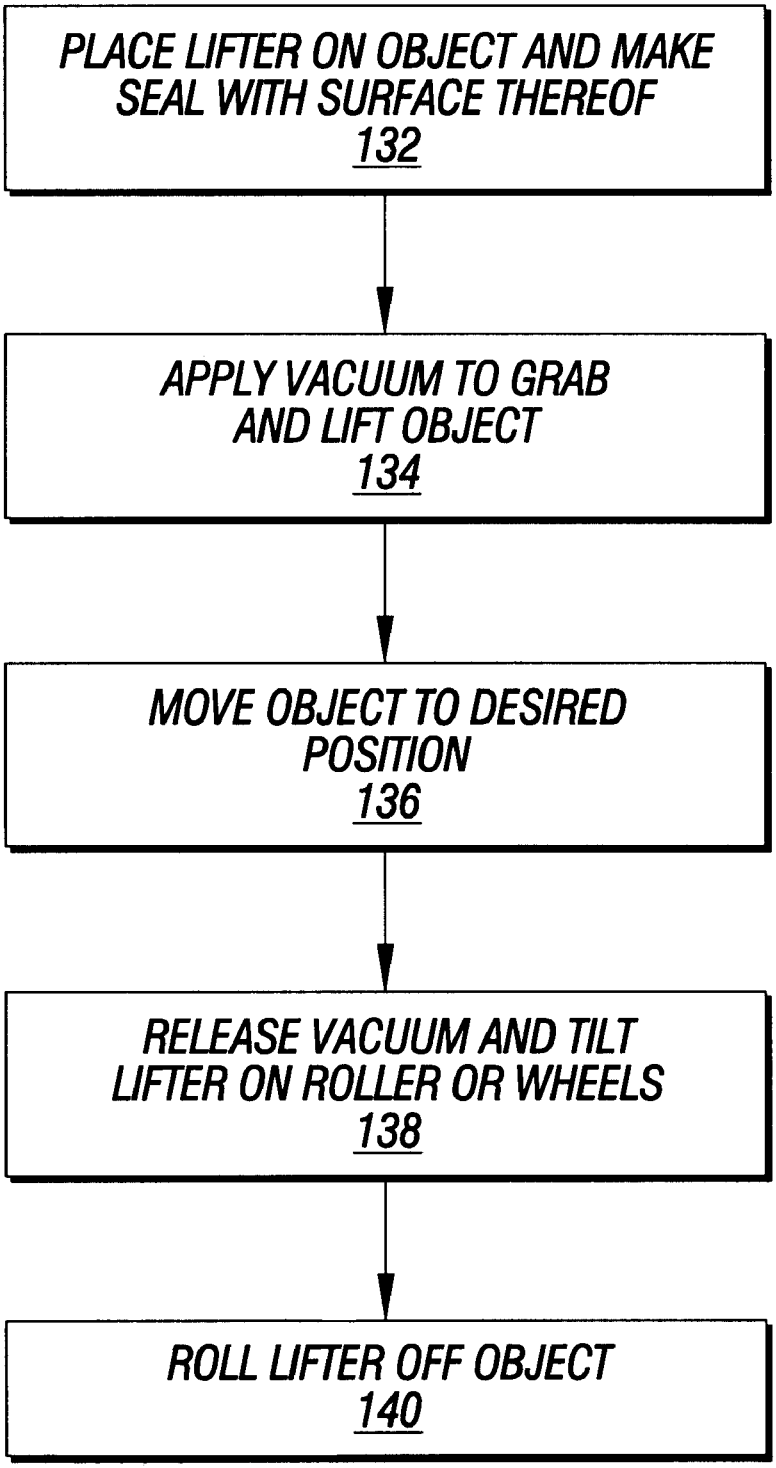
FIG. 8 is a flowchart illustrating one embodiment of a method for using the vacuum lifters of FIGS. 3 and 6.

FIG. 8 is a flowchart illustrating a method 130 for operating the vacuum lifters 50 and 51 of FIGS. 3 and 6, respectively in accord with one embodiment of the invention. At block 132, the lifter 50 or 51 is positioned on the surface 70 of the object 72 to be lifted. The operator, ordinarily a human operator, positions the lifter 50 or 51 on the surface 70 so that the sealing rings 66 can form a hermetic seal with the surface 70. At block 134, the operator adjusts the control levers 60 to apply a vacuum between the sealing plates 64 and the surface 70 so that the lifter 50 or 51 grabs the object 72. In some embodiments, the weight of the lifter 50 compresses the sealing rings 66 to form the airtight seals with the surface 70. In other embodiments, flexible arms, e.g., the flexible arms 120 in FIG. 5C, bend under a force applied by either the operator or the vacuum causing the rollers 74 and 94 to move out of the way. Subsequently, the sealing ring 66 makes an airtight seal with the surface 70. At block 136, the operator, ordinarily a human operator, moves the lifter 50 or 51 and the attached object 72 to the desired resting position.

At block 138, the operator uses the control levers 60 to release the vacuum holding the object 72. In the embodiment of FIG. 6 or FIGS. 3 and 5B, the operator subsequently tilts the lifter 51 or 50 by at least a preselected angle so that the lifter 51 or 50 rests on the rollers 76 or 74. The operator supports the other side of the lifter 51 or 50 himself by using the handles 58. Preferably, the vertical portion of the overhead hose 52 is sufficiently flexible to enable tilting the lifter 50 onto and off the rollers 74. In the embodiment of FIGS. 3 and 5C, the lifter 50 automatically pops above the surface 70 and rests on the rollers 74 as soon as the vacuum pressure below the sealing plates 64 is released. At block 140, the vacuum lifter 50 or 51 is rolled off the object 72 on the rollers 74 or 76, ordinarily by a human operator.

Figure 9A:
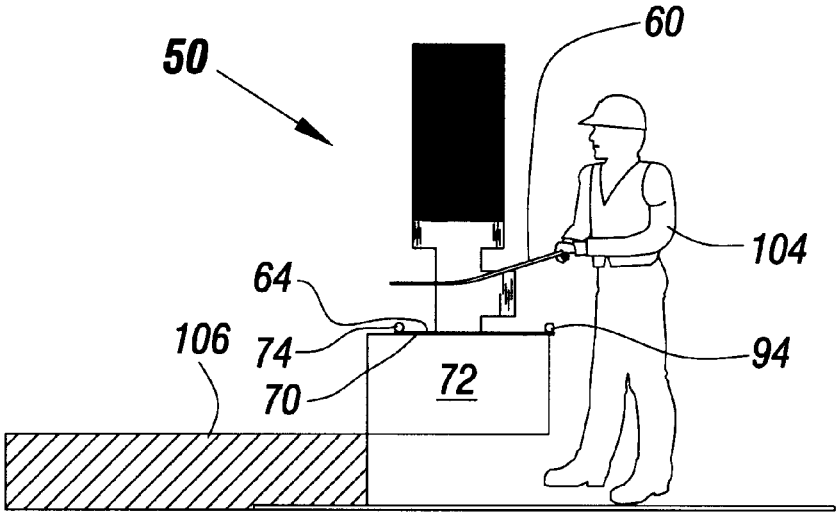
FIGS. 9A–9B illustrate the operation of the vacuum lifter of FIG. 3.
Figure 9B:
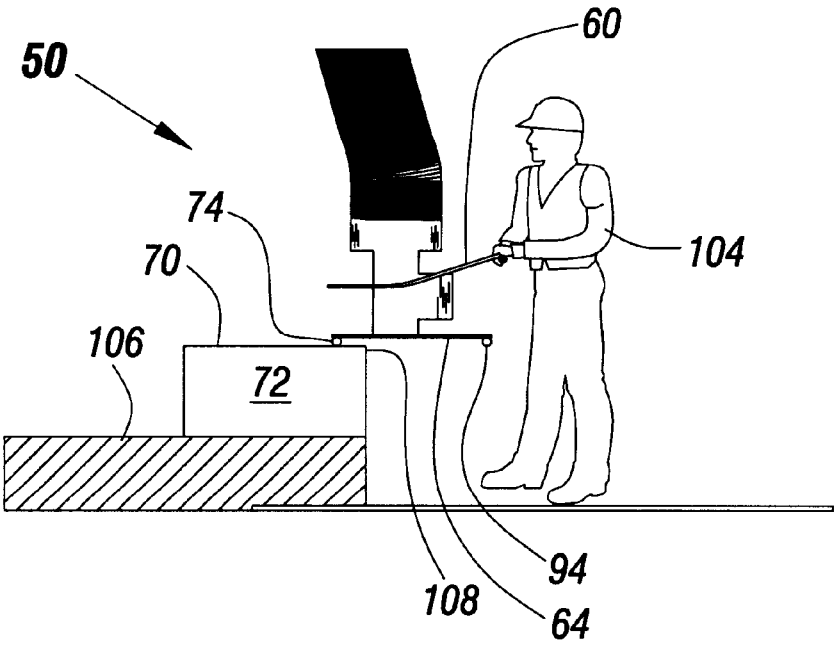

FIGS. 9A–9B more particularly illustrate the operation of the improved vacuum lifter 50 of FIG. 3 using the method of FIG. 8. The operator 104 positions the vacuum lifter 50 on the object 72, by lowering the lifter 50 onto the surface 70 and then using the rollers 74 to move the lifter 50 so that the sealing plates 64 can properly seal. Then, the operator 104 pushes the sealing plates 64 against the surface 70. In some embodiments, the weight of the lifter 50 is sufficient to push the sealing plates 64 against the surface 70. Then, the operator 104 applies a vacuum to the surface 70. Since the rollers 74 do not impede the formation of a clean contact between the sealing ring 66 and the surface 70, the vacuum forms a strong grip on the object 72. After the vacuum has formed a grip on the object 72, the operator 104 may displace, lift, and lower the object 72 with the vacuum lifter 50.

FIG. 9B illustrates the removal of the vacuum lifter 50 from the object 72 after having been positioned on a desired resting surface 106. The operator 104 uses the control lever 60 to release the vacuum between the sealing plate 64 and the surface 70 of the object 72. After the vacuum suction has been released, the operator uses the rollers 74 and 94 to roll the lifter 50 to an edge 108 of the surface 70. The rollers 74 and 94 allow the removal to proceed with less need to slide the heavy and bulky lifter 50 along the surface 70.

Remarks

The particular embodiments disclosed above are illustrative only, as the invention may be modified and practiced in different but equivalent manners apparent to those skilled in the art having the benefit of the teachings herein. For instance, the method of FIG. 8 might, in some embodiments, be performed robotically. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of moving a vacuum lifter off an object, comprising:

releasing a vacuum holding a surface of the object against a sealing plate of the vacuum lifter; and rolling the vacuum lifter along the surface on a roller to move the sealing plate off the surface of the object, the roller being connected to the vacuum lifter.

2. The method as set forth in claim 1, further comprising tilting the vacuum lifter by an angle at least as large as a preselected angle so that the roller rests on the surface before performing the act of rolling.

3. The method as set forth in claim 1, further comprising extending the roller distally from the lifter toward the surface of the object before performing the act of rolling, the act of extending significantly raising the lifter above the surface of the object.

4. The method as set forth in claim 3, wherein the act of extending includes relaxing at least one pair of flexible arms that extend the roller in response to the vacuum being released.

5. The method as set forth in claim 1, wherein the act of rolling is performed by a human operator or a robotic apparatus.

6. A method of operating a vacuum lifter, comprising:

positioning a sealing plate of the vacuum lifter on a surface of an object to be lifted;

forming a vacuum between the sealing plate and the surface of the object to be lifted;

moving the object with the vacuum lifter;

releasing a vacuum holding the object against the sealing plate; and rolling the vacuum lifter along the surface of the object to move the sealing plate off the surface of the object, a roller being connected to the lifter and resting on the surface of the object.

7. The method as set forth in claim 6, wherein the act of positioning includes rolling the vacuum lifter along the surface of the object on the roller.

8. The method as set forth in claim 6, further comprising tilting the vacuum lifter so that the sealing plate is supported above the surface of the object by the roller before the act of rolling.

9. The method as set forth in claim 6, further comprising the act of extending the roller toward the surface of the object in response to releasing the vacuum.

10. The method as set forth in claim 9, wherein the act of extending is performed by flexible arms that relax to extend the roller in response to a pressure on the arms due to the vacuum being released.

11. The method as set forth in claim 6, wherein the acts of positioning, moving and rolling are performed by a human operator.

12. A method of positioning a vacuum lifter on an object, compromising:

lowering the vacuum lifter onto a surface of the object;

rolling a roller attached to the vacuum lifter on the surface to position the vacuum lifter thereon;

forming a vacuum to grip a surface of the object to a sealing plate of the vacuum lifter; and retracting the roller towards the lifter after performing the act of rolling, the act of retracting enabling the sealing plate to form a hermetic seal with the surface of the object.

13. The method as set forth in claim 12, wherein the act of retracting includes bending at least one pair of flexible arms attaching the rollers to the vacuum lifter.

14. The method as set forth in claim 12, wherein the act of rolling is performed by a human operator or a robotic apparatus.

15. A method of operating a vacuum lifter, comprising:

positioning the vacuum lifter adjacent to a surface of an object to be lifted;

rolling a roller along the surface of the object to position a sealing plate on the surface of the object, the roller being connected to the lifter and resting on the surface of the object;

forming a vacuum between a sealing plate attached to the vacuum lifter and the surface of the object to be lifted; and retracting the roller toward the vacuum lifter in response to the act of forming a vacuum.

16. The method as set forth in claim 15, further comprising tilting the vacuum lifter so that the vacuum lifter contacts the surface of the object with the roller before the act of rolling.

17. The method as set forth in claim 15, wherein the act of retracting is performed by bending flexible arms that attach the roller to the vacuum lifter.

18. The method as set forth in claim 15, further comprising:

moving the object with the vacuum lifter; and then, rolling the vacuum lifter along the surface of the object with the roller after the vacuum between the sealing plate and the surface has been released.

19. The method as set forth in claim 15, wherein the acts of positioning, moving and rolling are performed by a human operator or a robotic apparatus.

* * * * *